US007641311B2

(12) United States Patent
Enomoto

(10) Patent No.: US 7,641,311 B2
(45) Date of Patent: Jan. 5, 2010

(54) INK JET PRINT HEAD AND MANUFACTURING METHOD THEREOF

(75) Inventor: Takanori Enomoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 506 days.

(21) Appl. No.: 11/488,629

(22) Filed: Jul. 19, 2006

(65) Prior Publication Data

US 2007/0019044 A1 Jan. 25, 2007

(30) Foreign Application Priority Data

Jul. 22, 2005 (JP) ..... 2005-213361

(51) Int. Cl.
*B41J 2/135* (2006.01)

(52) U.S. Cl. ..... 347/45

(58) Field of Classification Search ..... 347/20, 347/45, 47, 67

See application file for complete search history.

(56) References Cited

U.S. PATENT DOCUMENTS 6,733,111 B2 * 5/2004 Yamamoto ..... 347/47
6,940,692 B2 * 9/2005 Dai et al. ..... 360/125.72

* cited by examiner

*Primary Examiner*—An H Do
(74) *Attorney, Agent, or Firm*—Fitzpatrick, Cella, Harper & Scinto

(57) ABSTRACT

An ink jet print head includes a print element substrate having an ink ejection energy generator, a support substrate to support the print element substrate, and an ultraviolet light and heat combination setting adhesive bonding the print element substrate to the support substrate. A bonding surface of the support substrate on which the print element substrate is supported is formed with an ultraviolet light reflection prevention surface that prevents a reflection of ultraviolet light.

10 Claims, 15 Drawing Sheets

EVALUATION RESULT AFTER HIGH TEMPERATURE/HIGH PRESSURE WITHSTAND TEST
(PRINT HEAD IS IMMERSED IN DYE INK AND HEATED TO 120°C AT 2 ATM FOR 10 HOURS)

| | | EXAMPLE FOR COMPARISON | | EMBODIMENT OF THIS INVENTION (DARK COLOR SURFACE) | |
|---|---|---|---|---|---|
| | | PRINTED QUALITY (COLOR MIXING) | STATE OF EJECTION FROM NOZZLES (FROM ALL NOZZLES) | PRINTED QUALITY (COLOR MIXING) | STATE OF EJECTION FROM NOZZLES (FROM ALL NOZZLES) |
| QUANTITY OF ULTRAVIOLET LIGHT APPLIED | 0 J/cm2 | GOOD | NOZZLE CLOGGED | GOOD | NOZZLE CLOGGED |
| | 2 J/cm2 | GOOD | NOZZLE CLOGGED | GOOD | NOZZLE CLOGGED |
| | 5.5 J/cm2 | GOOD | GOOD | GOOD | GOOD |
| | 7.5 J/cm2 | GOOD | GOOD | GOOD | GOOD |
| | 10 J/cm2 | GOOD | GOOD | GOOD | GOOD |
| | 12 J/cm2 | COLOR MINING OCCURRED | GOOD | GOOD | GOOD |
| | 16 J/cm2 | COLOR MINING OCCURRED | GOOD | GOOD | GOOD |
| | 20 J/cm2 | COLOR MINING OCCURRED | GOOD | GOOD | GOOD |
| | 24 J/cm2 | COLOR MINING OCCURRED | GOOD | GOOD | GOOD |
| | 36 J/cm2 | COLOR MINING OCCURRED | GOOD | GOOD | GOOD |
| | 50 J/cm2 | COLOR MINING OCCURRED | GOOD | GOOD | GOOD |
| | 100 J/cm2 | COLOR MINING OCCURRED | GOOD | GOOD | GOOD |

FIG.15

INK JET PRINT HEAD AND MANUFACTURING METHOD THEREOF

BACKGROUND OF THE INVENTION

1. Field of the Invention

The present invention relates to an ink jet print head and a manufacturing method thereof.

2. Description of the Related Art

Generally, an ink jet print head comprises a print element substrate and a support substrate. The print element substrate has ejection energy generation means, such as electrothermal transducers, ink ejection openings (or nozzles) and an ink introducing port. The support substrate is formed with an ink supply port.

The print element substrate and the support substrate are positioned and bonded together by an adhesive, which hardens by ultraviolet light and heat (hereinafter referred to simply as an adhesive), so that the ink supply port communicates with the ink introducing port. The adhesive used has a coupling agent, such as silane coupling agent, added thereto to enhance an intimate contact between the support substrate and the print element substrate.

If the coupling agent is not added to the boding agent, a high level of intimate contact cannot be obtained between the support substrate and the print element substrate during the hardening of the adhesive. Therefore, after the adhesive hardens, a part of the adhesive may flake off with elapse of time, causing problems, such as ink leaking out to an outer circumference of the print element substrate.

Further, if the adhesive that is hardened by ultraviolet light and heat is not used and a thermosetting adhesive that is hardened only by heat is used, the print element substrate must be held immovable in its place with high accuracy until the adhesive begins to exhibit enough adhesive force to fix the print element substrate in its position. This deteriorates a workability in a production process and therefore a mass producing performance.

For these reasons, it is effective to use the adhesive that hardens by ultraviolet light and heat. That is, the adhesive is first hardened in a short time by ultraviolet light to temporarily fix the position of the print element substrate with high accuracy. Then, those portions of adhesive that the ultraviolet light cannot reach is hardened by heat.

Since a part of such an ultraviolet light/heat setting adhesive hardens by ultraviolet light in a short time, the function of the coupling agent added to the adhesive may be lost in that part. That is, for the portion that has hardened in a short time by ultraviolet light, an improved intimate contact expected of the coupling agent cannot be realized. It is therefore desirable that the portion of the adhesive that is hardened by ultraviolet light be kept as small as possible on the condition that the print element substrate can be secured temporarily on the support substrate.

Because of its irregular reflections, the ultraviolet light that has struck the surface of the support substrate may reach those portions of adhesive that are not intended for direct exposure to the ultraviolet light, initiating their hardening. In such a case, those portions of adhesive that are supposed to harden by heat may also undesirably harden in a short time, deteriorating the reactivity of the coupling agent.

SUMMARY OF THE INVENTION

The present invention has been accomplished with a view to overcoming the above problems. It is therefore an object of this invention to provide an ink jet print head that improves an intimate contact between the print element substrate and the support substrate to enhance its reliability. It is also an object of this invention to provide a method of manufacturing the print head.

In a first aspect of the present invention, there is provided an ink jet print head comprising:

a print element substrate having an ink ejection means; and a support substrate to which the print element substrate is securely bonded by an ultraviolet light/heat setting adhesive having a coupling agent added thereto;

wherein a bonding surface of the support substrate on which the print element substrate is supported is formed with an ultraviolet light reflection prevention surface that prevents a reflection of ultraviolet light.

In a second aspect of the present invention, there is provided a print head manufacturing method for manufacturing a print head, wherein the print head has a print element substrate having an ink ejection means, and a support substrate to which the print element substrate is securely bonded by an ultraviolet light/heat setting adhesive having a coupling agent added thereto;

the print head manufacturing method comprising the steps of:

forming an ultraviolet light reflection prevention surface on a bonding surface of the support substrate on which the print element substrate is to be supported;

applying the adhesive to the bonding surfaces of the print element substrate and the support substrate;

radiating the ultraviolet light against the adhesive to cause it to harden; and applying heat to the adhesive to cause it to harden.

The coupling agent mentioned above is a combination at a molecular level of a hydrolyzing group, which easily bonds to inorganic components (materials not containing carbon), and an organic functional group, which easily bonds to organic components (materials containing carbon). By adding this coupling agent to the adhesive, a wettability between the adhesive and objects to be bonded can be improved, thereby enhancing the intimate contact between the objects as the adhesive hardens.

According to this invention, an ultraviolet light reflection prevention surface is formed on a bonding surface of the support substrate to which the print element substrate is bonded. This ultraviolet light reflection prevention surface prevents diffused reflections of ultraviolet light, which would otherwise harden the ultraviolet light/heat setting adhesive more than necessary, and thereby ensures that the coupling agent in the adhesive fully performs its function to improve the intimate contact between the printing element substrate and the support substrate.

This in turn prevents an ink leakage and a failure to eject ink due to failed intimate contact and improves an accuracy in fixing the print element substrate in its position on the support substrate, improving the ink landing position accuracy. It is therefore possible to provide a high quality ink jet print head.

The above and other objects, effects, features and advantages of the present invention will become more apparent from the following description of embodiments thereof taken in conjunction with the accompanying drawings.

Further features of the present invention will become apparent from the following description of exemplary embodiments (with reference to the attached drawings).

BRIEF DESCRIPTION OF THE DRAWINGS

FIG. 15 is a table showing a result of performance evaluation on the ink jet print head of this invention.

DESCRIPTION OF THE EMBODIMENTS

First Embodiment

Now, a first embodiment of the ink jet print head according to this invention will be described by referring to the accompanying drawings.

First, referring to FIG. 10 and FIG. 11, a basic construction of the ink jet print head of this invention will be described before explaining about characteristics of the print head.

Figure 10:
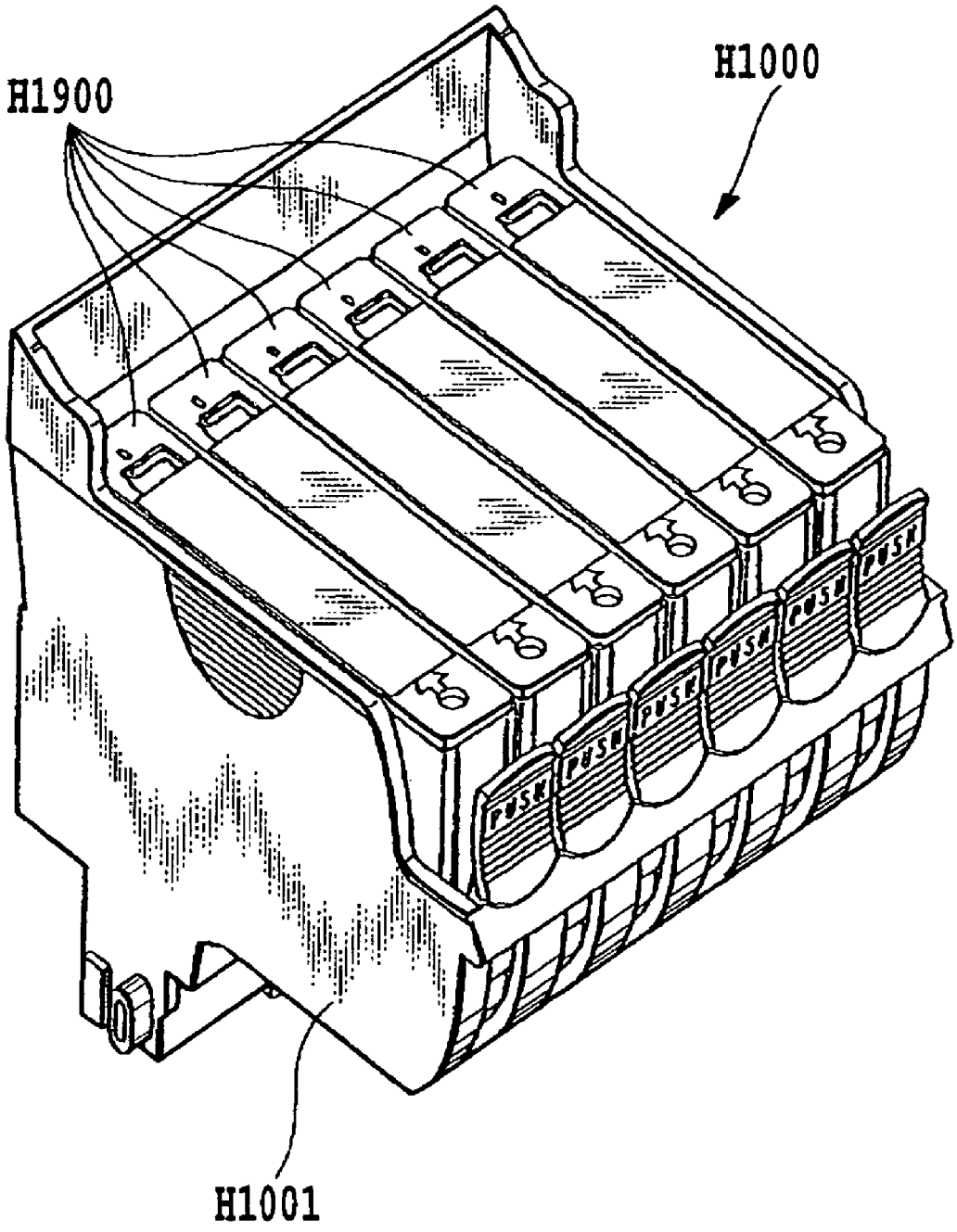
FIG. 10 is a perspective view showing a basic construction of an ink jet print head according to this invention.

FIG. 10 is a perspective view showing a print head cartridge H1000. The print head cartridge H1000 has an ink tank H1900 accommodating ink and a print head H 1001 that ejects the ink supplied from the ink tank H1900 from its nozzles according to print information. The print head H1001 is of a so-called cartridge type that is removably mounted on a carriage (not shown) described later.

Figure 11:
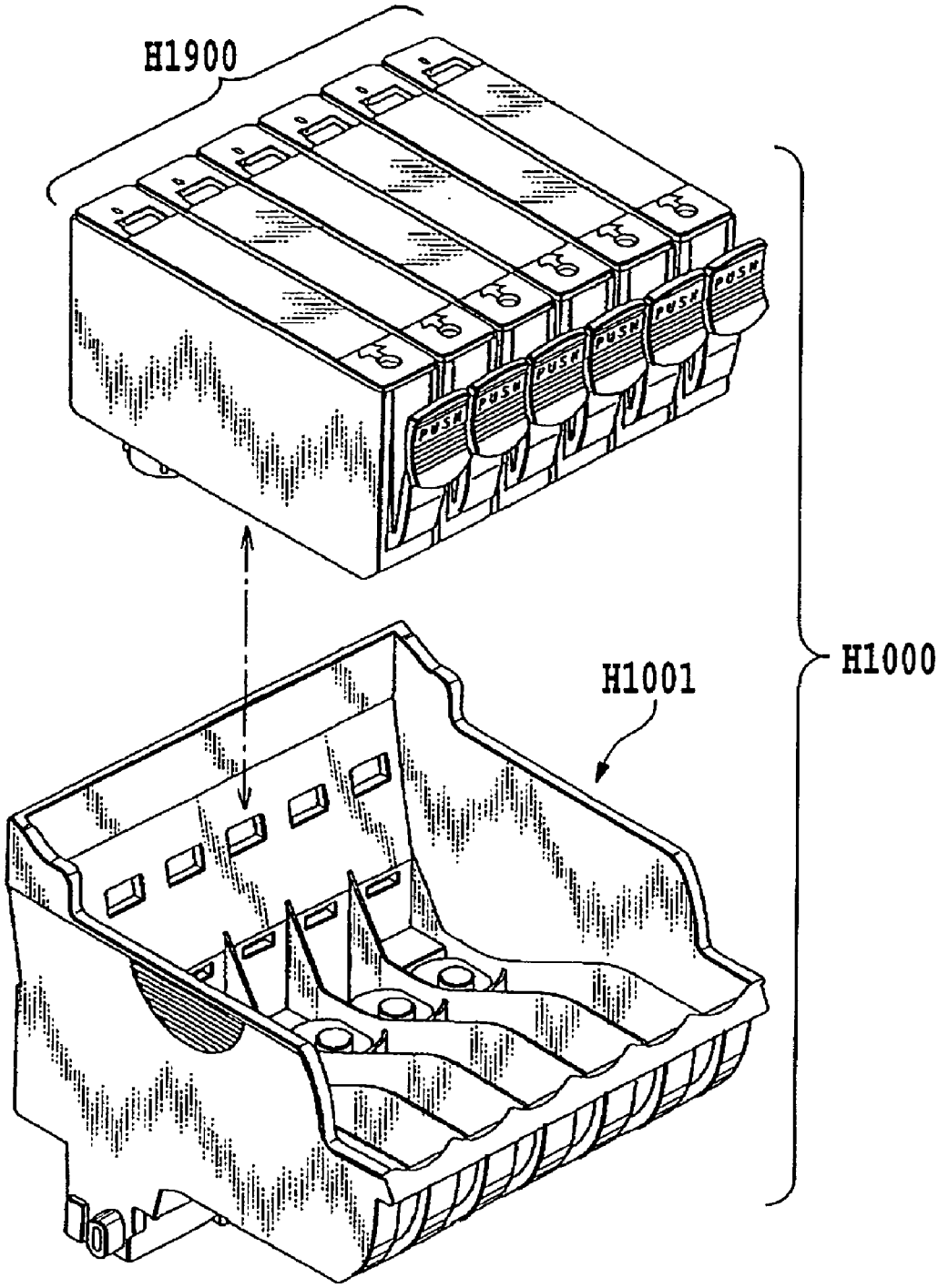
FIG. 11 is an exploded perspective view showing the ink jet print head and ink tanks of FIG. 10.

FIG. 11 is an exploded perspective view showing the print head cartridge H1000 in an exploded state. The print head cartridge H1000 has a total of six ink tanks H1900 independently containing black, light cyan, light magenta, cyan, magenta and yellow ink, each removably mounted on the print head H1001, for color printing with as high a print image quality as photographs.

Figure 12:
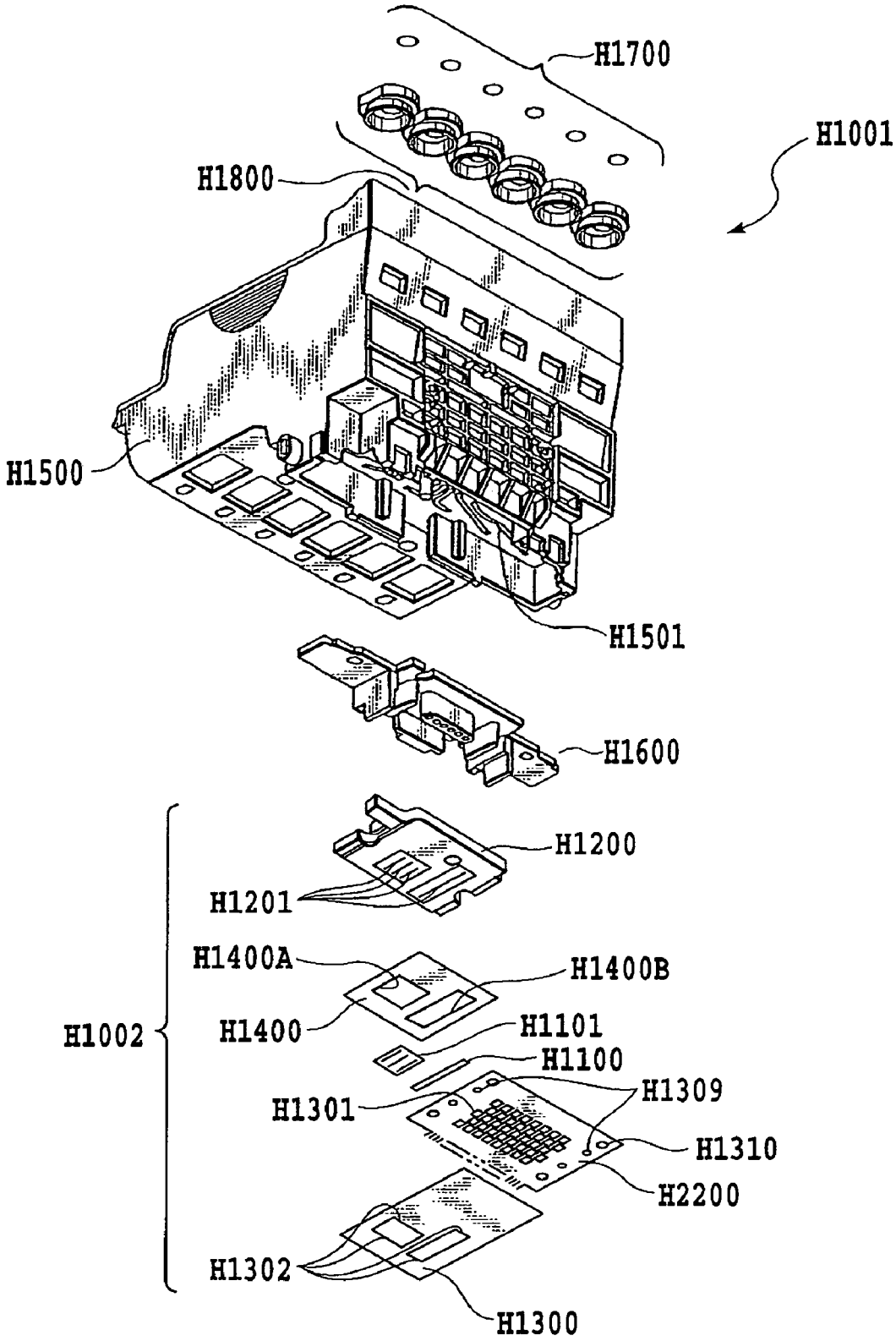
FIG. 12 is an exploded perspective view of the ink jet print head of FIG. 10.

FIG. 12 is an exploded perspective view showing the print head H1001 in a disassembled state. The print head H1001 has a print element unit H1002, a tank holder H1500, a flow path member H1600, a filter H1700, and a seal rubber 1800. As shown in the figure, the print element unit H1002 comprises two kinds of print element substrates H1100, H1101 for ink jet printing, a first plate H1200 as a support member, an electric wiring tape H1300 as a flexible wiring board, an electric contact board H2200, and a second plate H1400 as a second support member that constitutes a print element substrate accommodating member.

The two kinds of print element substrates are bonded and secured to the first plate H1200. Also bonded and secured to the first plate H1200 is the second plate H1400 formed with openings H1400A, H1400B. To this second plate H1400 is bonded and secured the electric wiring tape H1300 which is set in a predetermined positional relationship with the print element substrates H1100, H1101.

This electric wiring tape H1300 is used to apply ink ejection electric signals to the print element substrates H1100, H1101 and has electric wires for the print element substrates H1100, H1101 connected to the electric contact board H2200. The electric contact board H2200 has an external signal input terminal H1301 to receive electric signals from the ink jet printing apparatus and is positioned and secured by a terminal positioning hole H1501 of the tank holder H1500.

The two kinds of print element substrates H1100, H1101 are provided, one for a black ink and one for each of yellow, magenta, cyan, light cyan and light magenta inks. The former has electrothermal transducers as ejection energy generation means arrayed on both sides of an ink supply port for the black ink. The latter similarly has electrothermal transducers as ejection energy generation means arrayed on both sides of an ink supply port for each of yellow, magenta, cyan, light cyan and light magenta inks.

Figure 13:
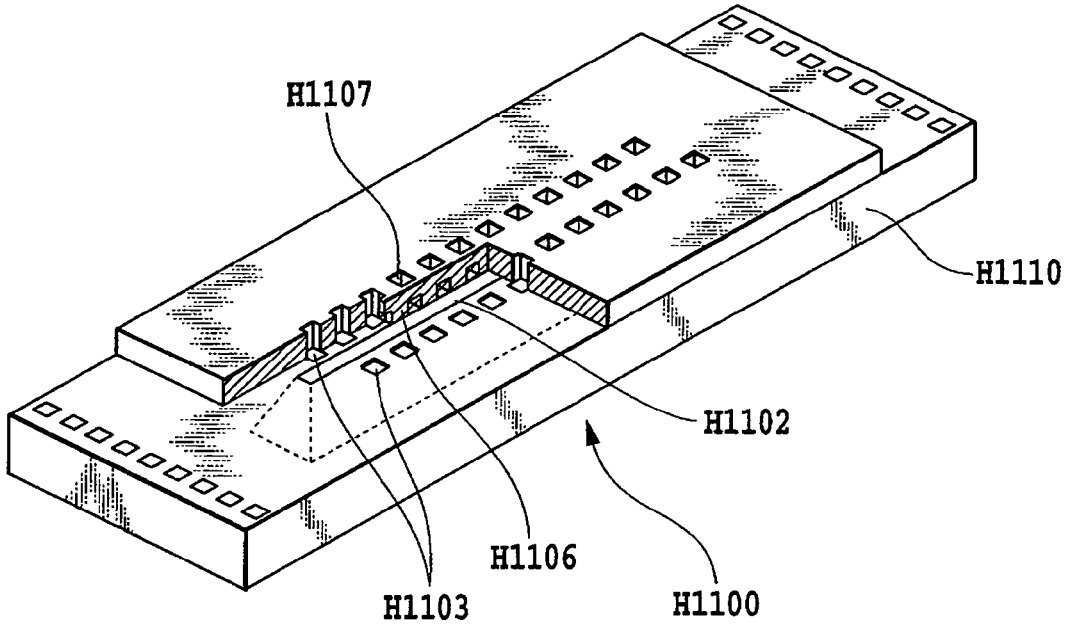
FIG. 13 is a perspective view showing a first print element substrate of FIG. 12 partly cut away.
Figure 14:
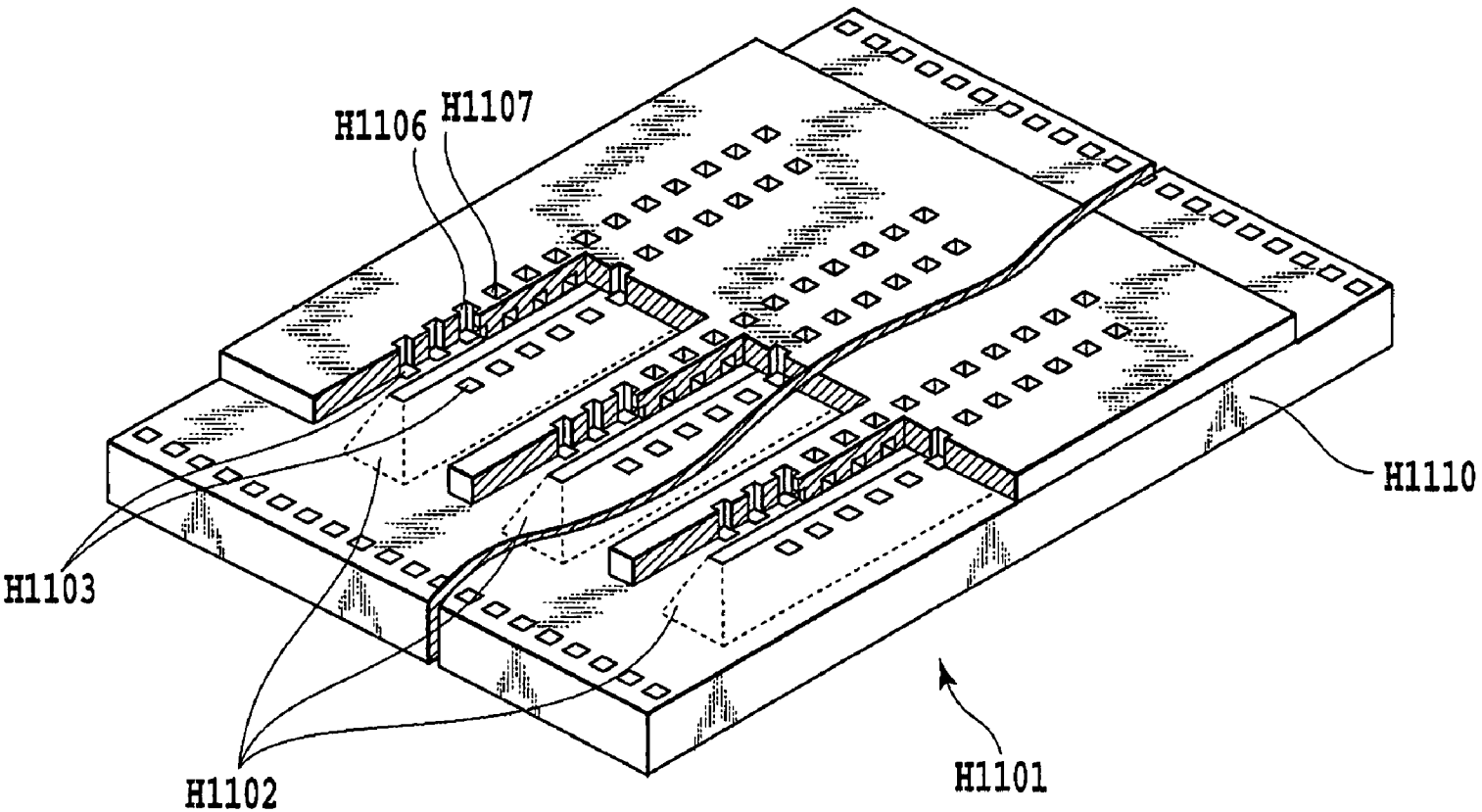
FIG. 14 is a perspective view showing a second print element substrate of FIG. 12 partly cut away.

FIG. 13 and FIG. 14 are perspective views schematically showing the two kinds of print element substrate of this embodiment partly cut away. These print element substrates, as shown, include a silicon substrate H1110 about 0.5-1 mm thick, one side of which is formed with a plurality of electrothermal transducers (heater) H1103 to eject ink. Arranged opposite the individual heaters H1103 are nozzles H1107 which communicate, through ink paths H1106 in a nozzle forming member, with the ink supply port 1102 that opens at the top surface of the substrate H1100. The ink supply port 1102 is an elongate slot covering a length of the array of nozzles or heaters H1103 and passes through the substrate H1100 and opens to the back thereof. The opening at the back of the substrate H1100 communicates with an ink communication port H1201 formed in the first plate H1200 for ink supply.

The heaters H1103 are arrayed in two staggered lines, one on each side of the ink supply port 1102. Thus, since the nozzles H1107 are arranged opposite the individual heaters 1103, ink supplied from the ink supply port 1102 is ejected from the nozzles by expanding bubbles generated by the heaters H1103.

Figure 1:
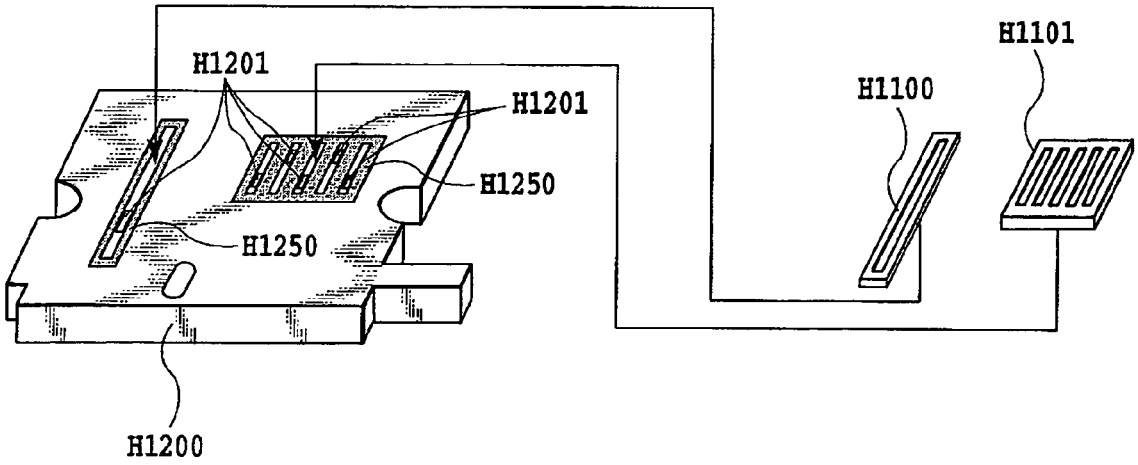
FIG. 1 is a perspective exploded view showing essential portions of an ink jet print head according to a first embodiment of this invention.
Figure 2:
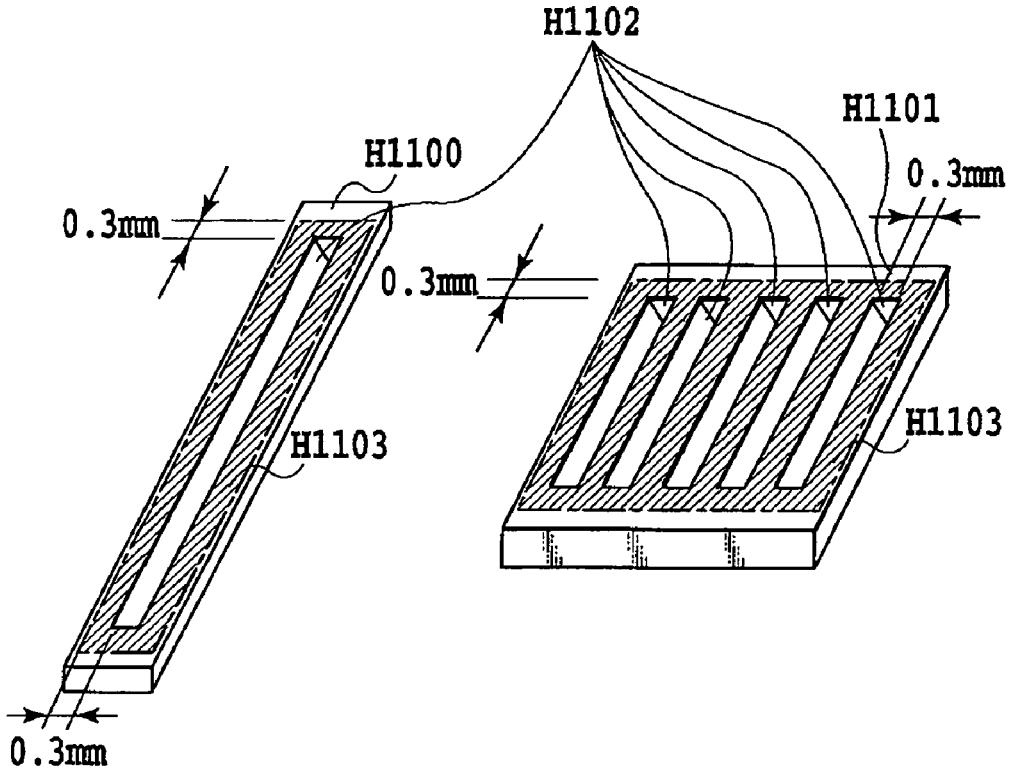
FIG. 2 is a perspective view of a print element substrate of FIG. 1 as seen from the back.
Figure 3:
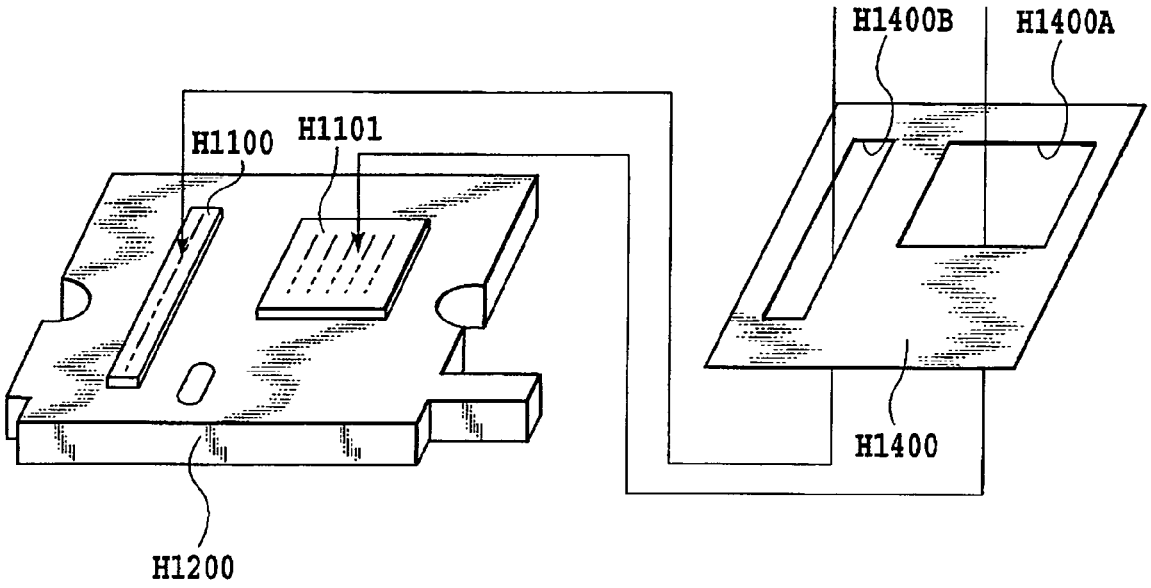
FIG. 3 is an exploded perspective view of essential portions of the ink jet print head.
Figure 4:
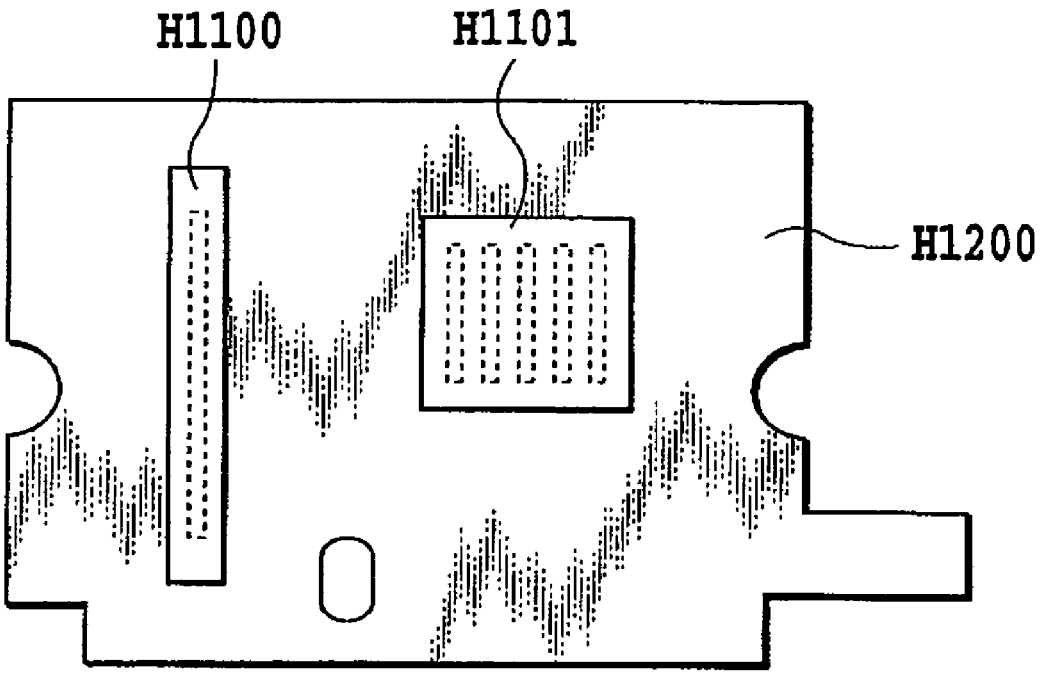
FIG. 4 is a plan view of a first plate of FIG. 3.
Figure 5:
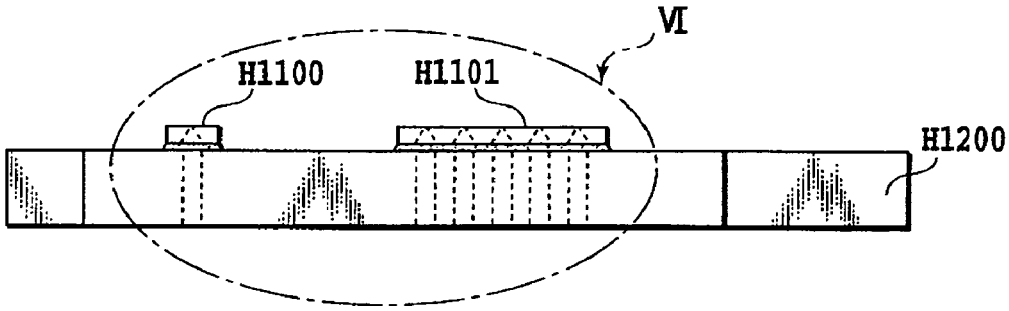
FIG. 5 is a side view of the first plate of FIG. 4.
Figure 6:
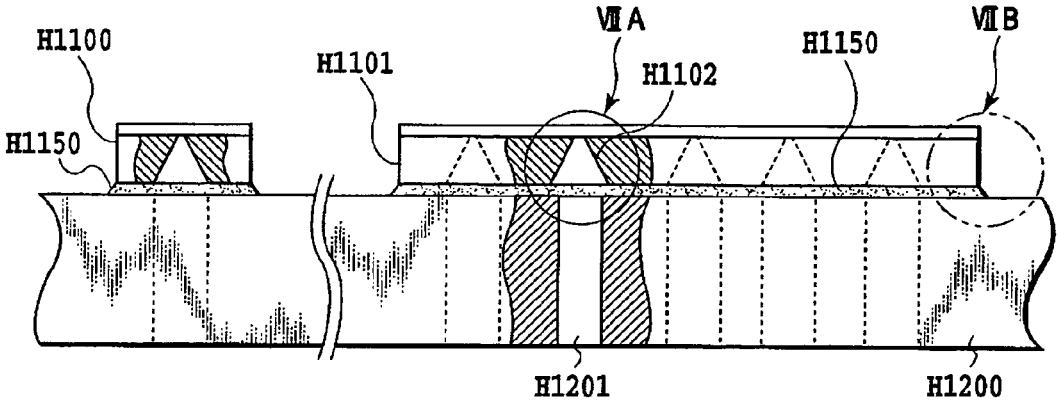
FIG. 6 is an enlarged view of a circle VI of FIG. 5.

Now, the construction of the ink jet print head characteristic of this embodiment will be explained. FIG. 1, FIG. 2 and FIG. 3 are schematic perspective views showing the characteristic construction of the ink jet print head of this embodiment. As described above, the first print element substrate H1100 and the second print element substrate H1101 are bonded to the first plate H1200 as a support substrate so that the ink supply ports 1102 formed in the print element substrates communicate with the ink communication ports H1201. For the bonding of the print element substrates, an ultraviolet light/heat setting adhesive with a coupling agent of silane coupling agent as an additive is used.

In this embodiment, areas H1250 on the surface of the first plate H1200 are coated with an ultraviolet diffused reflection prevention paint of dark color, as shown in FIG. 1. The area coated with the dark paint (ultraviolet light reflection prevention area H1250) is an area that is required to have a particularly high level of intimate contact at a bonding interface between the first plate and the first and second print element substrates. The areas H1250 in this example are within 0.3 mm of the outer circumferences of the ink supply ports 1102 of the first and second print element substrate. This area corresponds to a range H1103.

The first plate H1200 coated with the diffused reflection prevention paint at the area H1250 is heated and dried in a cure furnace at 100-120° C. for 0.5-2 hours to fix a colorant. The painted area H1250 is polished to a planar surface so that the print element substrates can be bonded to the first plate with an improved accuracy.

Figure 7A:
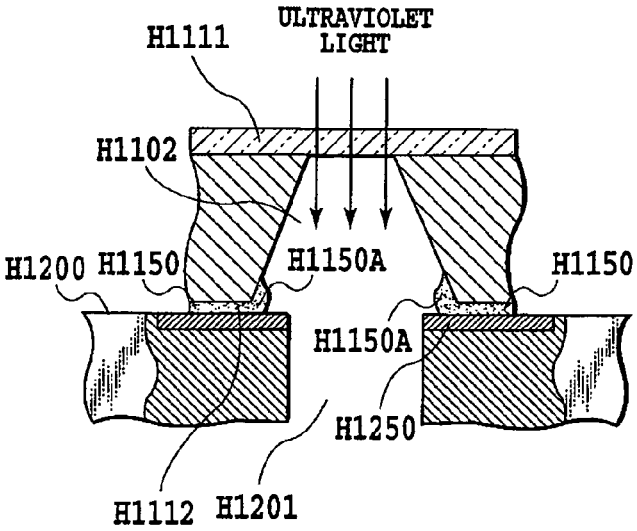
FIG. 7A is an enlarged view of a circle VIIA of FIG. 6 when ultraviolet light enters.
Figure 7B:
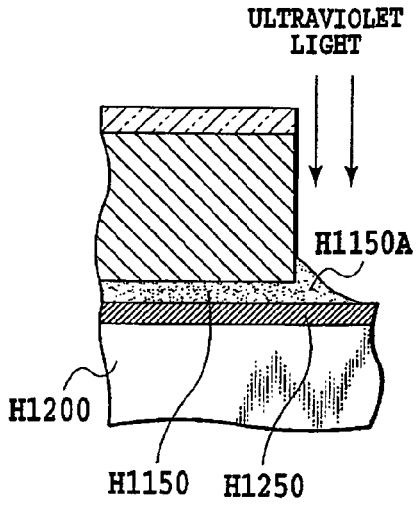
FIG. 7B is an enlarged view of a circle VIIB of FIG. 6 when ultraviolet light enters.
Figure 7C:
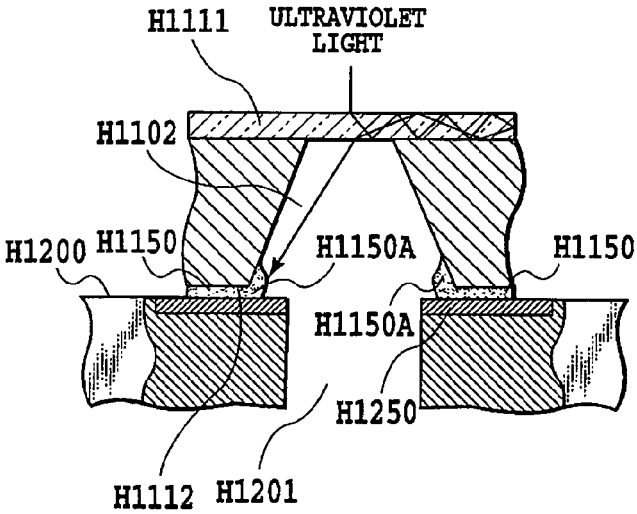
FIG. 7C is an enlarged view of the circle VIIA of FIG. 6 when ultraviolet light enters.

FIGS. 4, 5 and 6 and FIGS. 7A, 7B and 7C show how the print element substrates H1100, H1101 are bonded to the first plate H1200 by using the ultraviolet light/heat setting adhesive H1150 with an additive of coupling agent such as silane coupling agent. First, with the adhesive H1150 applied between the bonding surfaces of the first plate and the print element substrates, ultraviolet light is radiated against a part of the adhesive H1150 to harden it in a short time to temporarily secure the print element substrates to the first plate. In this example, as shown in FIG. 7A and FIG. 7B, ultraviolet light is shone from above the print element substrates through a covering member H1111 into the inside of the ink supply port 1102 and outer circumferences of the print element substrates. With this ultraviolet light exposure, a part of the ultraviolet light that has entered strikes that portion H1150A of the adhesive H1150 which is squeezed outside the bonding surface of the print element substrate, as shown in FIG. 7C, causing the portion H1150A to harden in a short time. With the portion H1150A of the adhesive hardened in a short time, the print element substrates are quickly secured to the first plate. Further, since the portion H1150A of adhesive at an edge portion H1112 of the ink supply port 1102 quickly hardens, the adhesive can be prevented from getting into the ink supply port 1102. Then, the other portion of the adhesive is hardened by heat to fully fix the print element substrates to the first plate.

When a portion H1150A of adhesive is hardened by ultraviolet light, the ultraviolet light is prevented from being irregularly reflected by the area H1250 on the surface of the first plate and thus does not get into the inner side of the bonding surface between the print element substrates and the first plate. Therefore, the adhesive H1150 is not hardened more than necessary by the ultraviolet light and the other portion than the portion H1150A fully exhibits the function of the coupling agent during the subsequent process of hardening by heat, fully fixing the print element substrates to the first plate with a high level of intimate bonding performance. The area H1250 for preventing diffused reflection of ultraviolet light is advantageously set large, covering an area beyond that directly exposed by ultraviolet light.

If ultraviolet light should be diffusedly reflected to enter into a portion of the adhesive more than necessary and that adhesive portion be hardened even slightly, the function of the coupling agent will not be fully exhibited during the subsequent process of hardening by heat. That is, the reactivity of the coupling agent may get dull, failing to produce a sufficient level of intimate contact between the bonding surfaces.

As described above, by using the first plate H1200 (support substrate) with a diffused reflection prevention coating in manufacturing an ink jet print head during the above process, the diffused reflection of ultraviolet light on the surface of the first plate H1200 is prevented when the first print element substrate H1100 and the second print element substrate H1101 are temporarily fixed by ultraviolet light. This prevents the adhesive from becoming hardened more than necessary by ultraviolet light and thus realizes a high intimate contact force in a subsequent, slow hardening process by heat without impairing the function of the coupling agent. As a result, a highly reliable ink jet print head can be provided.

Second Embodiment

Figure 8:
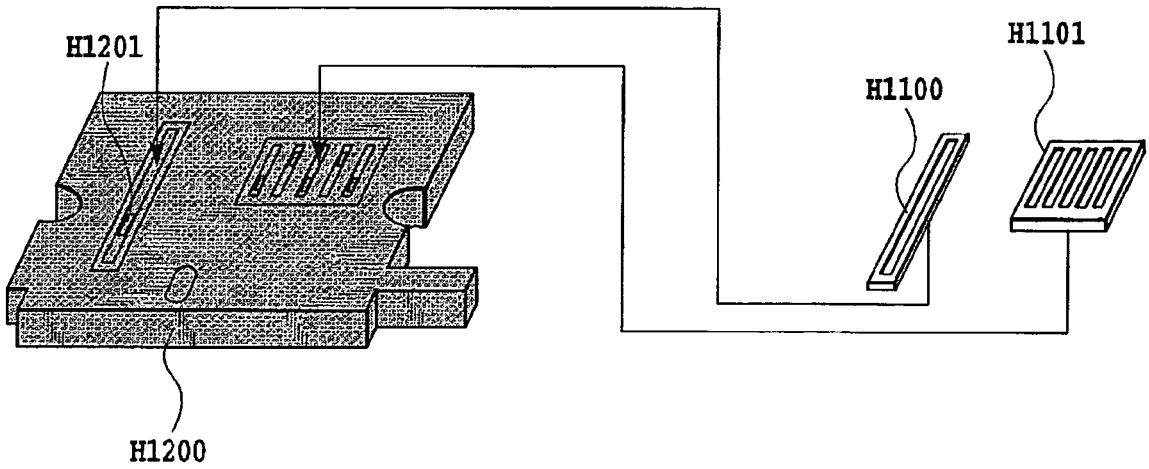
FIG. 8 is an exploded perspective view showing essential portions of an ink jet print head according to a second embodiment of the invention.
Figure 9:
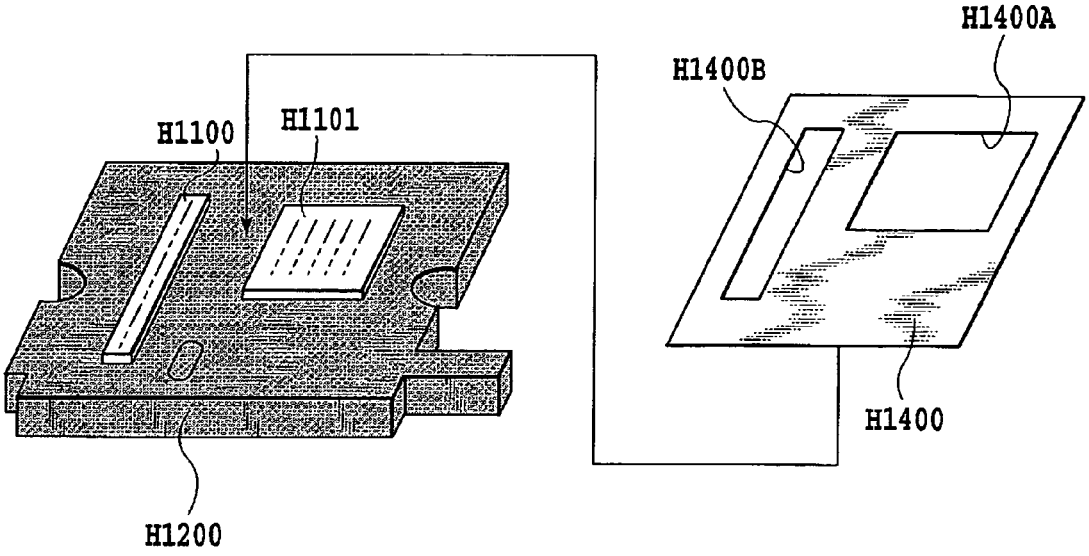
FIG. 9 is an exploded perspective view showing essential portions of an ink jet print head according to the second embodiment of the invention.

FIG. 8 and FIG. 9 are schematic diagrams showing constructions of essential portions of an ink jet print head according to a second embodiment of this invention. This embodiment differs from the first embodiment in the diffused reflection prevention method.

To produce an ultraviolet light diffused reflection prevention effect, this embodiment uses black ceramic $Si_3N_4$ (silicon nitride) as a material for the first plate H1200. Other materials for the first plate H1200 include SiC (silicon carbide)-, $ZrO_2$ (zirconia)- and AlN (aluminum nitride)-based dark color ceramics, and dark color ceramics having carbon added thereto. What is required is that the materials used can prevent a diffused reflection of ultraviolet light.

This embodiment also can produce the similar hardening effect to that of the first embodiment. Further, this embodiment does not require such a cumbersome procedure as treating the first plate with the diffused reflection prevention coating.

Third Embodiment

The first plate H1200 may be formed of such materials as $Al_2O_3$ (alumina)-, $ZrO_2$ (zirconia)-, and AlN (aluminum nitride)-based white ceramics and be evaporated on its surface with TiN, TiCN and TiAlN by physical vapor deposition (PVD) to form a dark color ultraviolet light diffused reflection prevention surface. The deposition may be achieved by chemical vapor deposition (CVD). For example, by chemically depositing TiC, TiN and TiCN, it is possible to form a dark color surface and thereby produce the similar ultraviolet light diffused reflection prevention effect.

The ultraviolet light diffused reflection prevention surface may be formed by roughening the surface of the first plate H1200. In this case, the roughened bonding interface can prevent the diffused reflection of ultraviolet light. Further, when viewed from a standpoint of the bonding strength, the roughened surface can be expected to produce an anchor effect at the bonding interface, which can improve the bonding strength as a secondary effect in addition to the primary effect of the bonding strength improvement realized by the diffused reflection prevention.

The diffused reflection of ultraviolet light can also be prevented by other means, such as adjusting compositions of the adhesive itself, lowering a transparency of the adhesive and adding a colorant.

FIG. 15 shows a result of performance comparison between ink jet print heads of this embodiment and an example for comparison. The former print head is formed with an ultraviolet light reflection prevention surface by making the surface of the first plate H1200 a dark color. The latter print head has a light color surface of the first plate H1200 not formed with the ultraviolet light diffused reflection prevention surface. In a manufacturing stage, both of these print heads were exposed to various quantities of ultraviolet light. As can be seen from FIG. 15, for small ultraviolet exposures of 0 J/cm$^2$ and 2 J/cm$^2$, both print heads resulted in nozzle clogging when ink was ejected from all nozzles. The print head of this invention produced good results in both the print quality and ejection state when the ultraviolet exposure was 5.5 J/cm$^2$ or higher. On the other hand, the print head for comparison resulted in a color mixing when exposed with more than 12 J/cm$^2$ of ultraviolet light. This is considered due to an insufficient contact between the first plate H1200 and the print element substrates.

The print head of this invention could be exposed with ultraviolet light without a problem for up to 100 J/cm$^2$, much higher than 7.5 J/cm$^2$. It is therefore possible to harden the adhesive in a shorter time and improve a fixing position accuracy when securing the print element substrates to the support substrate. As a result, an ink landing position precision has improved, realizing an ink jet print head capable of printing high-quality images.

As for the adhesive at the edge portion H1112 of the ink supply port 1102 at the back of the print element substrates, it was hardened normally by ultraviolet light entering from above the member H1111 that covers the print elements and liquid chamber, as shown in FIG. 7C. As a result, this portion of adhesive could exhibit the function of preventing ingress into nozzles of the adhesive that has not yet hardened.

Any desired method of radiating ultraviolet light or any radiation direction may be chosen. It is also possible to use a mask and apply ultraviolet light to only those portions of adhesive which one wants hardened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-213361, filed Jul. 22, 2005, which is hereby incorporated by reference herein in its entirely.

What is claimed is:

1. An ink jet print head comprising:

a print element substrate having ink ejection energy generating means;

a support substrate to support the print element substrate; and an ultraviolet light and heat combination setting adhesive bonding the print element substrate to the support substrate;

wherein a bonding surface of the support substrate on which the print element substrate is supported is formed with an ultraviolet light reflection prevention surface that prevents a reflection of ultraviolet light.

2. An ink jet print head according to claim 1, wherein bonding surfaces between the print element substrate and the support substrate are formed with an ink supply port and an ink communication port, respectively, both of which communicate with each other;

wherein the ultraviolet light reflection prevention surface is situated around the ink communication port.

3. The ink jet print head according to claim 1, wherein the ultraviolet light reflection prevention surface of the support substrate is formed of a dark color paint.

4. The ink jet print head according to claim 1, wherein the ultraviolet light reflection prevention surface of the support substrate is formed by surface roughening.

5. The ink jet print head according to claim 1, wherein the ultraviolet light reflection prevention surface of the support substrate is formed into a dark color surface by physical or chemical deposition.

6. The ink jet print head according to claim 1, wherein the ultraviolet light reflection prevention surface of the support substrate is also formed on other surfaces than the bonding surface to which the print element substrate is to be bonded.

7. The ink jet print head according to claim 6, wherein the support substrate is formed of a dark color member.

8. The ink jet print head according to claim 7, wherein the support substrate is formed of a dark color resin having C (carbon) added thereto.

9. The ink jet print head according to claim 7, wherein the support substrate is formed of $Si_3N_4$ (silicon nitride)- or SiC (silicon carbide)-based dark color ceramic.

10. The ink jet print head according to claim 7, wherein the support substrate is formed of $ZrO_2$ (zirconia)- or AlN (aluminum nitride)-based dark color ceramic.

* * * * *